United States Patent [19]

Potoroka

[11] 4,030,649

[45] June 21, 1977

[54] CLOTHES HANGER CARRIER

[76] Inventor: Victor W. Potoroka, 8610 S. Keeler Ave., Chicago, Ill. 60652

[22] Filed: Apr. 1, 1976

[21] Appl. No.: 672,545

[52] U.S. Cl. ..... 224/45 T; 16/110 R

[51] Int. Cl.[2] ..... B65D 71/00

[58] Field of Search ..... 224/45 T, 55, 58, 49, 224/45 P, 45 Q, 5 R, 28 A, 5 M, 5 N, 5 Z, 57, 12; 297/74; 206/300; 16/125, DIG. 19, 110 R; 229/52 R, 52 B, 52 A, 68 C

[56] References Cited

UNITED STATES PATENTS

| | | | |
|---|---|---|---|
| 1,722,052 | 7/1929 | Lackey | 224/45 N |
| 2,782,974 | 2/1957 | Borgfeldt | 224/45 T |
| 3,564,590 | 9/1969 | Hebel | 224/45 T |
| 3,759,430 | 9/1973 | Ward | 224/45 T |
| 3,893,604 | 7/1975 | Skinner | 224/45 T |
| 3,961,734 | 6/1976 | Threeton, Sr. | 224/45 T |

*Primary Examiner*—Robert J. Spar
*Assistant Examiner*—Kenneth Noland

[57] ABSTRACT

A device particularly adapted for carrying clothes hanger-type garment bags of the kind often carried on board aircraft, the device comprising a body stamped or otherwise formed from suitable sheet material, the body having a handle end, a hanger hook-engaging end and an intermediate shoulder-engaging portion connecting said ends, the intermediate portion having a cut-away portion to enable the carrier to be positioned closer to the user's neck than if the cut-away portion were not provided, the body further comprising a flat blank having slit portions adapted to be suitably bent by the user to further adapt the same for use as a carrier.

5 Claims, 5 Drawing Figures

CLOTHES HANGER CARRIER

BRIEF SUMMARY OF THE INVENTION

This invention relates to clothes hanger carriers and, more particularly, to a carrier that will permit comfortable carrying of garment bags, such as are often carried on board aircraft, with clothes hanger hooks extending from the top thereof.

A walk through any busy aircraft terminal will quickly reveal that inexpensive, soft-sided, portable garment bags, such as those that often come with the purchase of men's suits, for example, and within which several articles of clothing may be hung, have become extremely popular with aircraft passengers. This is especially so in the case of relatively short business trips.

Such a bag is normally formed with a slot at the top thereof, through which the hooks of the clothes hangers in the bag extend, and it is the usual practice for the traveler to carry the bag by grasping the hook (or hooks) with the fingers, generally the index and/or middle fingers. No matter whether there is one or several hanger hooks, it is extremely uncomfortable, if not painful and/or even injurious, to carry even a moderately heavy clothes bag any distance in that manner. In fact, the imprint of the hooks is often left on the fingers, to the extent that it is sometimes temporarily difficult to straighten the fingers after carrying a heavy bag by the hooks a long distance in one hand, with additional luggage in the other hand.

Because this is a problem, devices for carrying garment bags have been proposed. However, since not many such devices appear to be in use, it is assumed that they have certain disadvantages, such as lack of comfort or excessive cost of manufacture, for example.

Accordingly, some of the objects of the invention are to provide such a carrier that is inexpensive to make and comfortable to use and (a) requires a minimum of manufacturing operations, with no assembly of individual parts, and (b) comprises a stamped blank that is easily and quickly prepared for use by the user himself.

Other objects and advantages of the invention will become apparent by reference to the detailed description and the attached drawings.

DETAILED DESCRIPTION

Figure 1:
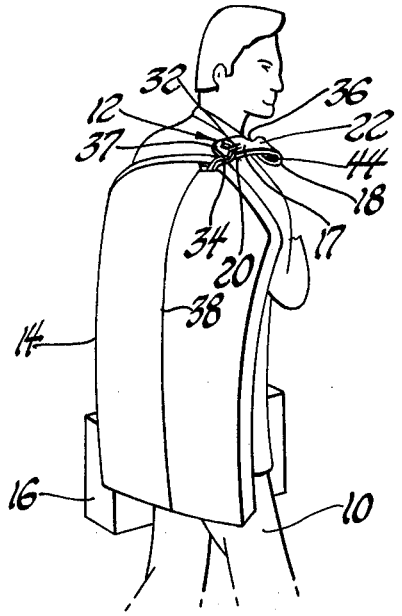
FIG. 1 is a perspective view of a traveler using a carrier device embodying the invention.

Referring now to the drawings in greater detail, FIG. 1 illustrates how an air traveler 10 would employ a carrier 12 embodying the invention to carry a garment bag 14, such as that referred to above. The traveler's other hand is usually occupied in carrying some other item, such as a briefcase 16, and he is normally in a hurry so that it is inconvenient to stop and shift these items (bag and briefcase) to opposite hands, at least until he reaches his next immediate destination, such as a car rental desk, the aircraft boarding gate or the like. This creates the need for a device for comfortably carrying the bag 14.

Figure 3:
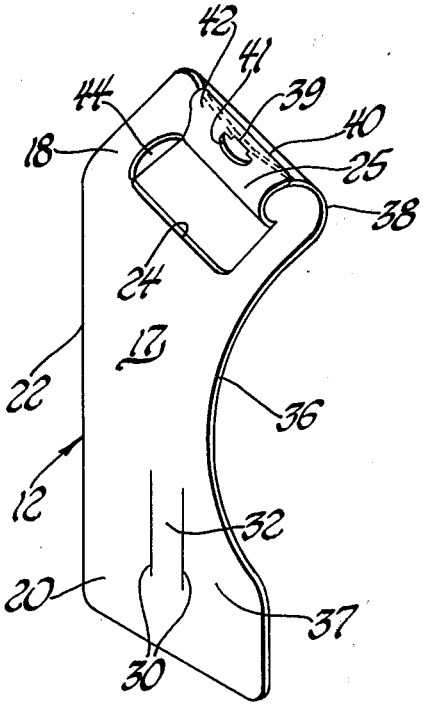
FIG. 3 is a perspective view of the device shown in FIGS. 1 and 2, as it may be prepared for use by the user.
Figure 5:
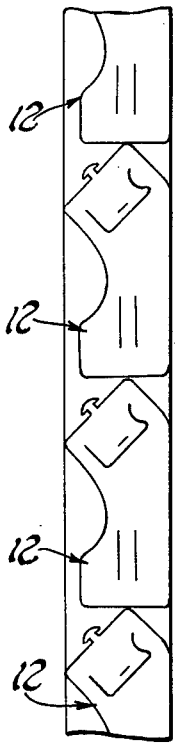
FIG. 5 is a plan view of one preferred means of manufacture of a carrier embodying the invention.
Figure 2:
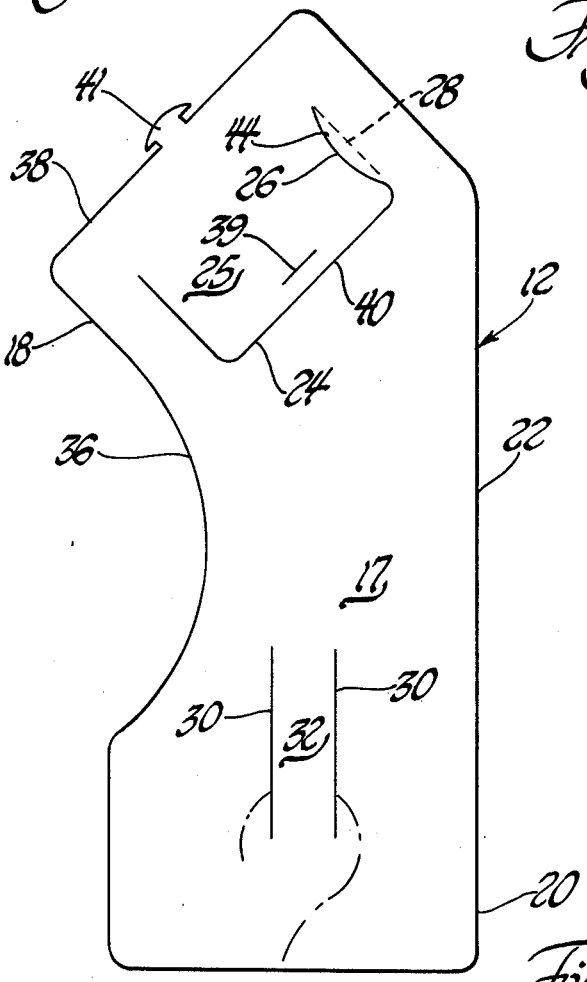
FIG. 2 is a top plan view of the stamped and slit blank condition of the carrier shown in FIG. 1, as it may be manufactured and purchased.
Figure 4:
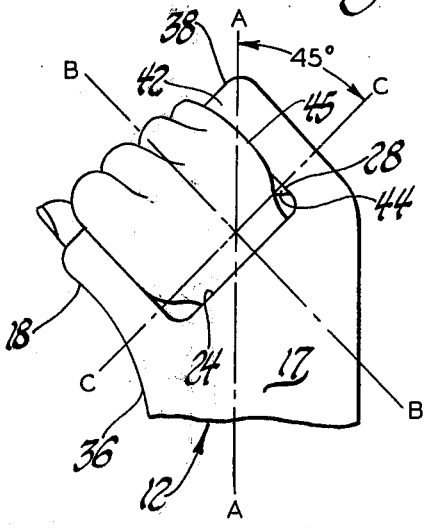
FIG. 4 is a fragmentary portion of FIG. 2, showing, in more detail, certain features of the invention in use.

Referring now to FIGS. 2–4, it will be seen that the carrier 12 comprises a preferably single-piece body 17, such as may be stamped (FIG. 5) or otherwise formed from a suitable sheet material having flat opposite sides and a uniform thickness free of any projections. The body 17 has a handle end 18, a hanger hook-engaging end 20 and an intermediate shoulder-engaging portion 22 connecting the ends 18 and 20. FIG. 5 illustrates a manner in which carriers 12 could be continuously stamped or cut, in the form of blanks 17, from a strip of suitable sheet material, preferably a pliable material such as some of the modern plastics that are at the same time durable and resistant to tearing and the like. This is in accordance with a main object of the invention, which is to provide an inexpensive, one-piece blank having no separate reinforcing structure and requiring no secondary manufacturing operations, and from which the carrier 12 can be completed by the user, himself, as by bending portions thereof to a desired configuration, The handle end 18 may be cut to form a generally U-shaped slit 24, one side 26 of the slit being inwardly curved, and a slight crease at 28 to facilitate folding, for a purpose to be described. The U-slit 24 provides a three-sided integral flap 25 having a free end 40 generally parallel to the free edge 38 of the handle end 18 of the carrier, the purpose of which will be explained. The hook-engaging end 20 may be formed with parallel slits 30, providing an intermediate strip or loop portion 32 on which the clothes hanger hooks 34 can be hung, as shown in FIG. 1. A cutout 36 may be formed in one side of the intermediate portion 22 to make carrying more comfortable and stable by accommodting the user's neck, as also shown in FIG. 1. For example, the cutout 36 enables the hook loop to be disposed closer to the middle of the back (and less likely to slip off the shoulder) than if the cutout were not employed, without interference with the user's neck and collar and with better weight distribution medially.

It will be noted that the loop portion 32 is disposed near the lower end of cutout 36, leaving a smooth, large-area sheath portion 37 to protect the user's back and shoulders from the hooks 34.

It will be further noted that a slot 39 is cut near the center of free end 40 and that free edge 38 is formed with a tab 41 opposite slot 39, for a purpose to be described.

It will be apparent that the user can himself form a comfortable, generally-cylindrical or tubular handle 42 simply by rolling or forming the edge 38 portion of the end 18 and the end 40 portion of the flap 25 out of the plane of the blank 17 and toward each other, as shown in FIGS. 1, 2 and 4, and securing the handle 42 by inserting tab 41 in slot 39. At the same time, the side 26 may be folded downwardly on the lines 28 to provide a more comfortable, larger-area, flat surface or protective flap 44 (as opposed to a cut edge) against which the outer side of the hand 45 may rest during carrying.

In FIG. 4, A—A is what will be referred to herein as the general longitudinal centerline of the carrier 12, C—C is a line parallel to the general axis of the handle 42 and B—B is the natural general position of the user's arm during carrying. Thus, it will be noted that the axis C—C of handle 42 is not normal to the centerline A—A of the carrier; rather, it is askew, at an angle of about 45°, such that the user's wrist does not have to be bent from its generally straight comfortable position, as it would have to be if the axis C—C were normal to centerline A—A.

It will thus be observed that the user can very simply and quickly form the blank 17 shown by FIGS. 2 and 5 to the carrying configuration of FIGS. 1, 3 and 4. Further, the carrier blank is adapted to just as easily be formed by the user in a reverse manner to adapt the carrier for carrying on the left shoulder, without loss of the advantages of the cutout 36 and angled handle 42, and without any separate hanger hook or other portions projecting from the sheet body 17 to cause shoulder discomfort.

While dimensions are not critical to the invention, it may be of interest to note that experimentation has shown that average carrier overall dimensions approximately on the order of 15 inches overall length, 5 inches width and 3/64 inch thickness, with the strip 32 being 1 inch wide and 2½ inches long and the handle flap 25 being 2 inches wide, 4½ inches long and formed so that the handle 42 will be positioned at an angle of about 45° with respect to centerline A—A, provide a durable and comfortable carrier when formed from a suitable plastic material. Of course, these dimensions may be varied as desired, such as to accommodate different size hands and the like.

From the above description and drawings, it is apparent that the invention provides a very simple, comfortable and inexpensive clothes hanger carrier that may (1) preferably comprise a single-piece device that can be formed by a single stamping or cutting operation, (2) have no costly separate support structure, (3) be formed from a sheet plastic strip of uniform thickness, (4) be reversible for right or left hand use, with no protruding or other structures to interfere with reversibility, (5) provide a cylindrical or tubular handle by simply rolling or forming portions of the handle end thereof and securing the same by slot-tab means, (6) prevent uncomfortable edge contact with the hand by folded portions and/or (7) provide carrying comfort due to an angled handle and/or a cut out neck portion.

It will be further apparent that a carrier embodying the invention may embody one or more, but not necessarily all, of the above features. For example, the askew (not normal to the carrier centerline) handle may be employed, with or without one or more of the other features taught herein. Obviously, the carrier 12 is adapted for carrying garment hangers without a garment bag 14 or other hooked articles.

The invention, and the manner of making and using the same, has been described in such full, clear, concise and exact terms as to enable any person skilled in the art to which the invention appertains to make and use the same.

While one embodiment of the invention has been shown and described, certain changes may be made without departing from the scope of the invention, and no limitations are intended, except as contained in the claims.

What I Claim as my invention is:

1. An over-the-shoulder carrier for hand carrying articles such as one or more clothes hangers of the type having a garment-support portion and an open hook extending from the top of the support portion, said carrier comprising a single-piece and single thickness body, free of separate assembled elements, stamped or otherwise formed from suitable sheet material of commercially uniform thickness, said body having a longitudinal general centerline. a handle end having a free edge disposed at an angle within the plane of said body and not normal to said centerline and adapted to be rolled to form part of a tubular handle, a hanger hook-engaging end formed near its middle with spaced longitudinal cuts to provide a hook-engaging loop and an intermediate shoulder-engaging portion connecting said ends and being free of fadded elements said body having substantially flat opposite sides both free of any projections which extend normal to the plane of said body so as to be reversible for right or left shoulder carrying.

2. A carrier such as that recited in claim 1, wherein said intermediate portion is formed with a distinct cutout at one side thereof to receive the user's neck and enabling said carrier to be positioned closer to the user's neck in either right or left shoulder carrying than if said cutout were not provided.

3. A carrier such as that recited in claim 1, wherein said handle portion is formed with a generally U-shaped cut providing a three-sided integral flap, the free end of said flap being generally parallel to and opposite said free edge of said handle end, whereby said free edge and said free end may be rolled out of the plane of said body and toward one another to form a generally tubular handle for said carrier, both said free edge and said free end being disposed at an angle not normal to said centerline of said body, whereby said handle will be disposed at an angle.

4. A carrier such as that recited in claim 1, wherein means are provided to prevent sheet edge contact with the side of the user's hand during carrying, said means being an integral part of said single-piece body.

5. An over-the-shoulder carrier for hand carrying articles such as one or more clothes hangers of the type having a garment-support portion and an open hook extending from the top of the support portion, said carrier comprising a body stamped or otherwise formed from suitable sheet material, said body having a longitudinal general centerline, a handle end having a free edge, a hanger hook-engaging end and an intermediate shoulder-engaging portion connecting said ends, said body having substantially flat opposite sides free of any projections and a generally uniform thickness, said body comprising a blank wherein said handle end is slit to form a generally U-shaped flap attached to said body adjacent said free edge of said handle end, said flap and that portion of said handle end on the free edge side of flap being adapted to be rolled out of the plane of said body to form a tubular or substantially cylindrical handle, integral slot-tab means for retaining said handle in the formed position, said handle being at an angle to said longitudinal centerline of said body not normal thereto, said intermediate portion of said body having a cutout on the side thereof to be positioned adjacent the user's neck, and said hook-engaging end being formed with spaced slits substantially parallel to said centerline to provide a loop to receive clothes hanger hooks, said hook-engaging end extending beyond said loop to provide a sheath preventing contact of portions of said hangers with the user.

* * * * *